US006811572B2

(12) United States Patent
Hashimoto et al.

(10) Patent No.: US 6,811,572 B2
(45) Date of Patent: Nov. 2, 2004

(54) PLUSH LEATHER-LIKE SHEET PRODUCT AND METHOD FOR PRODUCTION THEREOF

(75) Inventors: Takafumi Hashimoto, Shiga (JP); Koji Watanabe, Shiga (JP); Tetsuya Ito, Gifu (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 10/070,782

(22) PCT Filed: Jul. 12, 2001

(86) PCT No.: PCT/JP01/06058

§ 371 (c)(1),
(2), (4) Date: Mar. 12, 2002

(87) PCT Pub. No.: WO02/06582

PCT Pub. Date: Jan. 24, 2002

(65) Prior Publication Data

US 2003/0037381 A1 Feb. 27, 2003

(30) Foreign Application Priority Data

Jul. 17, 2000 (JP) ..... 2000-216047
Apr. 9, 2001 (JP) ..... 2001-109802

(51) Int. Cl.[7] ..... C14C 1/00; D06P 5/02; B44F 7/00

(52) U.S. Cl. ..... 8/94.15; 8/94.18; 8/442; 428/15

(58) Field of Search ..... 8/94.15, 442; 428/15

(56) References Cited

U.S. PATENT DOCUMENTS 5,679,418 A * 10/1997 Akasawa ..... 428/15
5,876,466 A * 3/1999 Nakashima et al. ..... 8/442

FOREIGN PATENT DOCUMENTS

JP 3-287880 12/1991

* cited by examiner

*Primary Examiner*—Margaret Einsmann
*Assistant Examiner*—Preeti Kumar
(74) *Attorney, Agent, or Firm*—Piper Rudnick LLP

(57) ABSTRACT

The present invention relates to a suede-like sheet which is characterized in that, in a suede-like sheet comprising primarily ultrafine fiber of no more than 0.3 dtex and polyurethane, said polyurethane employs polymer diol containing 30 wt % to 90 wt % polycarbonate diol, said sheet contains from 20 wt % to 60 wt % of said polyurethane, the average nap length is 300 $\mu$m to 2000 $\mu$m, and the percentage retention of the local fatigue resistance before and after an accelerated ageing treatment is at least 50%, and it also relates to a method for the preparation of a suede-like sheet which is characterized in that, in the production of a suede-like sheet comprising a nonwoven fabric of ultrafine fibre of no more than 0.3 dtex and a polyurethane which employs polymer diol containing 30 wt % to 90 wt % polycarbonate diol, a buffing treatment is carried out after applying an antistatic agent to the sheet. By means of the present invention, it is possible to obtain a suede-like sheet which is ideal for clothing or as a seating fabric, where there is little exposure of polyurethane surface, which possesses an excellent nap which is elegant and outstanding in its evenness and, furthermore, which has a soft handle and even when employed over a prolonged period shows no lowering of strength or product quality such as rupture, fraying or pilling.

12 Claims, 3 Drawing Sheets

PLUSH LEATHER-LIKE SHEET PRODUCT AND METHOD FOR PRODUCTION THEREOF

TECHNICAL FIELD

The present invention relates to a suede-like sheet and to its method of production. More particularly, it relates to a suede-like sheet which is outstanding in its handle, strength, product quality and durability, and to a method for the production thereof.

PRIOR-ART

Suede-like sheet obtained by impregnating a sheet-shaped material comprising synthetic fibre with a polymer elastomer has an evenness, dye fastness and softness of handle not to be found with natural leather, and it has been widely used in clothing, furnishings and seating applications. In particular, suede-like sheet comprising primarily ultrafine fibre of fineness no more than 0.3 dtex and a polyurethane is outstanding in its product quality, surface feel and handle, and is widely employed not only for clothing but also for upholstery, car seats and the like.

However, when such suede-like sheet is used over a prolonged period, problems can arise such as rupture, or the nap being locally extended and entangled so that so-called fraying and pilling occur. One of the causes of such problems is degradation of the polyurethane and a number of attempts have been made to overcome this by employing a highly durable polyurethane.

For example, in terms of hydrolysis resistance, polyurethane employing a polyether-type diol (hereinafter referred to as a polyether-based polyurethane) is outstanding, but it has the problem of poor light resistance. On the other hand, polyurethane employing a polyester diol (hereinafter referred to as a "a polyester-based polyurethane") is excellent in its light resistance but it has poor hydrolysis resistance. Again, polyurethane employing a polycarbonate diol (hereinafter referred to as "a polycarbonate-based polyurethane") has comparatively good light resistance and hydrolysis resistance, but it is physically hard and there are difficulties in obtaining products with a soft handle. To overcome the disadvantages of the polycarbonate-based polyurethane, there have been proposed polyurethanes employing polycarbonate diols of special structure, and artificial leathers employing these polyurethanes have been proposed.

For example, in JP-A-5-43647, there is a description to the effect that by using a polyurethane which employs a non-crystalline polycarbonate diol there is obtained a leather-like sheet which is outstanding in its wear resistance, softness and hydrolysis resistance, but even using a polyurethane employing such a non-crystalline polycarbonate there is in fact very little improvement in the softness and this remains a long way from target levels.

Furthermore, in JP-A-4-300368 there is described the use of a polyurethane which includes a polyester-based diol containing dicarboxylic acid units and $C_5$–$C_6$ alkanediol units derived from optionally methyl-substantially comprising carbanyl units and $C_8$ to $C_{10}$ alkanediol units derived from at least one type of alkanediol selected from the group comprising optionally methyl-substituted 1,8-octanediol and 1,9-nonanediol. In this way, an artificial leather is obtained which combines both softness and durability but, even by this method, there is not obtained leather-like sheet having sufficient durability.

Moreover, if one attempts to soften the sheet-shaped material with a reduction in the amount of polyurethane applied, when the sheet is used for a prolonged period degradation of the polyurethane remains unavoidable and adequate durability is not obtained. In particular, the local failure resistance is unsatisfactory.

If an attempt is made to obtain a soft leather-like sheet suitable for light garments in particular, it becomes even more difficult to achieve a good balance of softness and durability, and in practice it is currently impossible to obtain a sheet where these are satisfactory.

Thus, as explained above, hitherto, merely by improving polyurethane durability, it has not been possible to obtain a suede-like sheet, in particular a thin suede-like sheet, which is outstanding in its softness, strength and durability.

DISCLOSURE OF THE INVENTION

The first objective of the present invention lies in providing a suede-like sheet which combines softness, good handle and elegant appearance, and which is outstanding in its durability (specifically in its local failure resistance, fraying resistance and pilling resistance).

The suede-like sheet of the present invention which achieves this objective has the following constitution. Specifically, it is a suede-like sheet which is characterized in that, in a suede-like sheet comprising primarily ultrafine fibre of no more than 0.3 dtex and polyurethane, said polyurethane employs polymer diol containing 30 wt % to 90 wt % polycarbonate diol, said sheet contains 20 wt % to 60 wt % of said polyurethane, the average nap length is 300 $\mu$m to 2000 $\mu$m, and the percentage retention of the local failure resistance before and after an accelerated aging treatment is at least 50%.

An objective of the invention also lies in providing a method for stably producing this suede-like sheet. For this, the invention has the following constitution.

Specifically, it is a method for the production of a suede-like sheet which is characterized in that, in the preparation of a suede-like sheet comprising a nonwoven fabric of ultrafine fibre of no more than 0.3 dtex and a polyurethane employing polymer diol containing 30 wt % to 90 wt % polycarbonate diol, a buffing treatment is carried out after applying an antistatic agent to the sheet.

In The Diagrams

Figure 1:
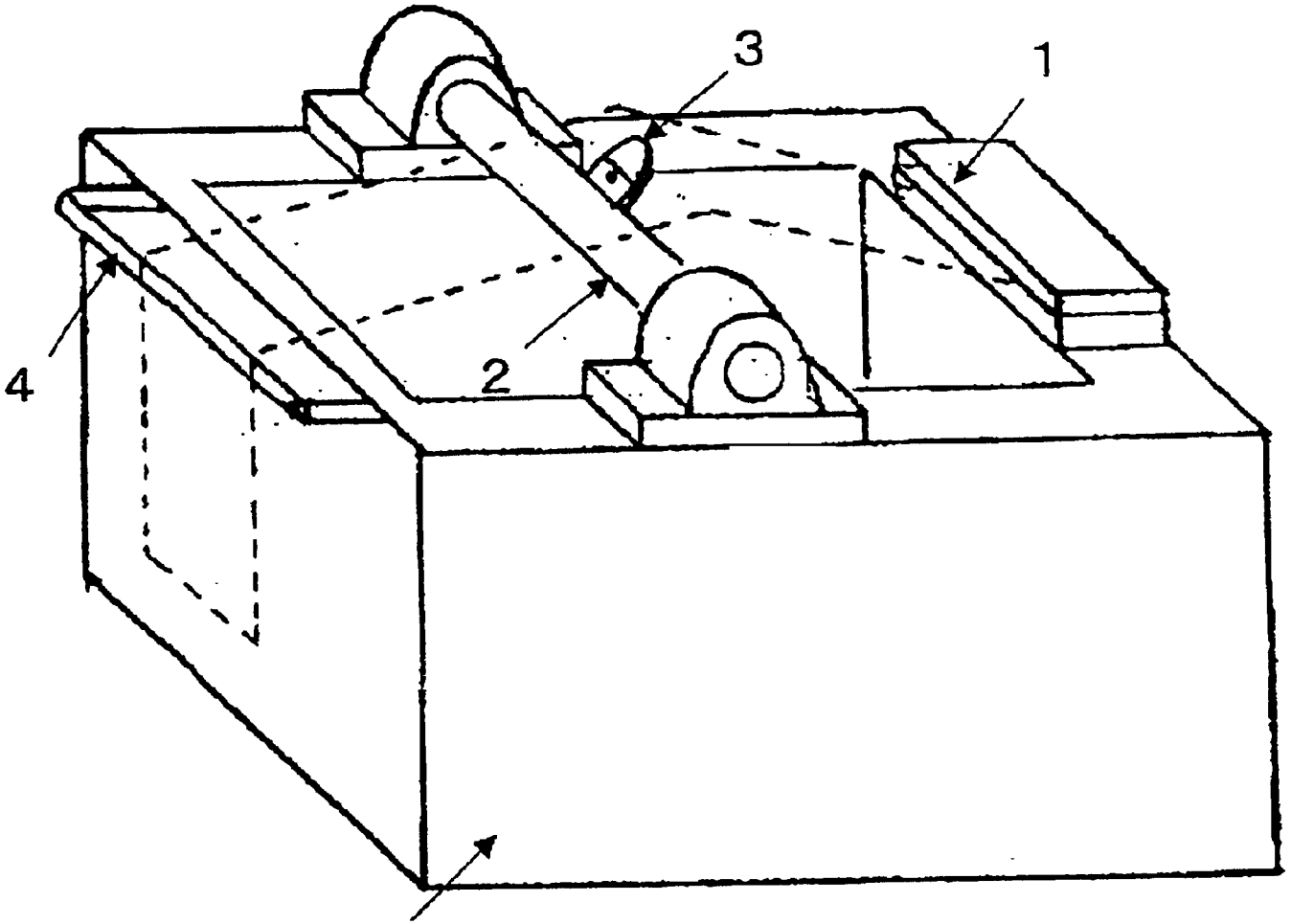
FIG. 1 is an outline diagram showing the form of the local failure resistance tester in the present invention.

| | |
|---|---|
| 1 | sheet-shaped clamp |
| 2 | rotating roller |
| 3 | fingernail-shaped portion |
| 4 | guide roller |
| 5 | support |
| 6 | leather-like sheet material |
| 7 | weight |

Optimum Form for Practising the Invention

The present invention is characterized by the use of ultrafine fibre of 0.3 dtex or below. The material for this ultrafine fibre is not particularly restricted and there can be used known polyesters typified by polyethylene terephthalate, polybutylene terephthalate and polypropylene terephthalate, and known polyamides typified by nylon 6, nylon 6,6 and the like. Now, the fineness of the ultrafine fibre needs to be 0.3 dtex or below from the point of view of softness and product quality, but from the point of view of colouring properties and openability, the range 0.005 to 0.3 dtex is preferred in the case of polyester fibre and the range 0.001 to 0.1 dtex is preferred in the case of polyamide fibre. In particular, polyester ultrafine fibre of fineness 0.01 to 0.3 dtex is more preferred in terms of durability. Moreover, there can also be used a mixture of aforesaid ultrafine fibres providing this is within a range such that the objectives of the invention are not impaired, and there may also be included fibre which is thicker than 0.3 dtex providing again that the objectives of the invention are not impaired. Furthermore, the cross-sectional shape of the ultrafine fibre may be the usual circular cross-section or there can also be used for example fibre of trilobal or tetralobal non-circular cross-section.

The method for obtaining such ultrafine fibre may be the method of directly producing the desired ultrafine fibre or the method of first producing thicker fibre after which the ultrafine fibre is manifested therefrom. However, from the point of view of the ease of obtaining thin fibre and from the point of view of the softness of the leather-like sheet obtained, there may favourably be employed the method in which there is first produced a fibre from which ultrafine fibre can be generated (hereinafter this is referred to as the ultrafine fibre-generating fibre), after which a treatment is carried out to produce said ultrafine fibre.

With regard to the form of this ultrafine fibre-generating fibre, there can be favourably employed conjugate fibre in which there are clad together polymers which can then be separated, or islands-in-a-sea type conjugate fibre in which one polymer contains another polymer present in the form of 'islands', or alternatively there can be used blended fibre in which polymers are mixed together. Furthermore, as examples of the types of polymer which may readily be eliminated at the time of such separation, there can be used polyolefins such as polyethylene and polystyrene, or copolyesters of raised alkali solubility based on the copolymerization of sodium-sulphoisophthalic acid, polyethylene glycol or the like.

The methods for separating the polymers by physical or chemical means are not particularly restricted, and for example there can be used the method of physically rubbing and breaking-apart the ultrafine fibre generating fibre or the method of bringing about shrinkage or swelling of at least one of the components by heating and/or with a chemical.

Next, a nonwoven web is prepared using the aforesaid fibre. There are no particular restrictions in terms of nonwoven web type, but from the point of view of quality and handle it is preferred that it be a staple nonwoven web. As methods for obtaining a staple nonwoven web, there can be used methods employing a card or cross-lapper, or a random webber, or alternatively papermaking methods can be employed. Again, by entanglement of the nonwoven web obtained by these methods, using needle punching or by means of a water jet, so that it is combined with some other woven, knitted or nonwoven material, there is the beneficial effect of conferring a suitable degree of stretch on, and restricting the elongation of, the sheet material. There are no particular restrictions on the water jet or needle punching methods, and there can be employed known equipment and conditions but, in the case of needle punching suitable adjustment is required of the needle shape, punch number and punch depth, and in the case of water jet punching suitable adjustment is required of the jet hole shape, size and water jet pressure, according to the fibre fineness, strength and the mechanical characteristics and surface quality of the target product.

In the method of production of the suede-like sheet of the present invention, it is preferred that formation of a sheet of the aforesaid ultrafine fibre-generating fibre contain, in the following order, (1) a stage in which two layers of nonwoven material comprising the ultrafine fibre-generating fibre are bonded together, one superimposed on the other, and
(2) a stage in which the ultrafine fibre is generated, after which slicing into two in the thickness direction is carried out.

By using this method of production, it is possible to obtain a suede-like sheet of outstanding strength even when thin.

In conventional methods of production, in the case where a thin leather-like sheet is to be obtained there has been adopted a method in which there is initially produced a thick nonwoven web and, after application of the polyurethane, the nonwoven web then sliced in the thickness direction. However, in the case of the suede-like sheet obtained in this way, the staple fibre from which the nonwoven web is constructed is cut by the slicing, so that the average fibre length is considerably shortened and the fibre entanglement strength is lowered, with the result that only a leather-like sheet of low strength is obtained.

On the other hand, in the production method in which the slicing is carried out after bonding together as aforedescribed, a thin nonwoven fabric is first produced and then layers thereof bonded together, so that even when subsequently sliced apart little cutting of the fibres occurs and there is practically no lowering of strength. Again, since the formation of the thin material by slicing takes place after applying the polyurethane, stretching in the urethane application stage is suppressed. In addition, there is also the merit of enhanced productivity since there is roughly a doubling of the apparent treatment rate while processing in the coupled state.

The present inventors have discovered that, in order to enhance the durability of the suede-like sheet, it is insufficient just to improve the polyurethane durability. However, by also improving the structure of the nonwoven web it becomes possible, for the first time, to achieve a high level of durability. The present invention is based on this discovery.

The method used for bonding together the layers of nonwoven material is not particularly restricted and there can be used, for example, the water-jet entanglement or needle punching methods, but the method of needle punching in a state with the layers of nonwoven material superimposed facilitates adjustment of the bonding strength, so is preferred. If the bonding together by such needle punching is too tight, there is a considerable lowering of strength following the slicing, while if it is too loose then the nonwoven materials will come apart during processing, making processing impossible. Hence, an appropriate degree of bonding will need to be achieved by suitable selection of the needle punching conditions, according to the particular properties of the nonwoven, for example its density and weight per unit area.

In bonding together the nonwoven material, there is firstly produced the nonwoven web and then, with two layers thereof superimposed, a bonding treatment is carried out. As the nonwoven material used in this bonding, there can be employed suitably-selected aforedescribed nonwoven material. It is preferred that there be employed nonwoven material in which the fibre entanglement or fibre density of the nonwoven web prior to the bonding is as high as possible but, if it is too high, then the bonding strength at the time of the bonding-together is weakened with the result that, in the after-processing of the bonded nonwoven web, separation may occur between the nonwoven material layers and considerable problems arise. Furthermore, if the entanglement of the nonwoven web used in the bonding is too low, then while the nonwoven bonding strength is raised there is a considerable lowering of the strength following slicing. Consequently, the nonwoven material used in such circumstances will be selected taking into account an overall balance of these factors. Now, here, there is described the case where typically two layers of nonwoven webs are bonded-together, but beneficial effects may in some cases be obtained by increasing the number of bonded layers, and the present invention does not exclude such cases.

The sheet thus obtained is then subjected to the polyurethane application and nap-forming treatments. Now, the order of the polyurethane application and nap-forming treatments is preferably suitably selected according to the particular type of sheet. For example, in the case of a material where the formation of a nap is difficult like with a woven material, a preferred means for obtaining a good nap comprises firstly forming the nap, next applying polyvinyl alcohol and then applying the polyurethane, with further nap-raising again being carried out where required.

The method of applying the polyurethane is preferably the method of impregnating the sheet with a polyurethane solution, and then immersing in water or in an aqueous organic solvent solution to bring about polyurethane coagulation. N,N'-dimethylformamide, dimethylsulphoxide or the like can be favourably employed as the solvent used in said polyurethane solution. Again, adding other solvent or water within a range such that the solubility of the polyurethane is not impaired is also a preferred means in terms of nap formation.

Furthermore, it is possible to add a coagulation regulator such as a higher alcohol or a surfactant, with the aim of adjusting the coagulated structure of the polyurethane. Moreover, optionally, there can be added pigments, ultraviolet absorbers or antioxidants.

With regard to the polycarbonate diol, if less than 30 wt % is used the durability is inadequate, so this is undesirable. If the amount exceeds 90 wt %, the handle becomes harsh, so this is undesirable. It is preferred that there be used from 40 to 90 wt %, with from 50 to 85 wt % being particularly preferred.

The polycarbonate diol referred to here is a compound where the diol skeletal structure has the form of a polymer chain with linkage effected via carbonate bonds, and where there are hydroxyl groups at the two terminals. The diol skeletal structure will be determined by the glycol used as the starting material and its type is not particularly restricted. For example, there can be used 1,6-hexanediol, 1,5-pentanediol, neopentyl glycol or 3-methyl-1,5-pentanediol. Of these, the 1,6-hexamethylene polycarbonate diol obtained using 1,6-hexanediol has a good balance in terms of durability, softness and strength. Furthermore, with copolycarbonate diols based on using at least two glycols selected from this group of glycols, there can be obtained a leather-like sheet which is especially outstanding in its softness and appearance. Moreover, in the case where a leather-like sheet of especially outstanding softness is to be obtained, it is possible to introduce, into the polymer diol, bonds other than carbonate bonds, for example ester or ether bonds, providing this is within a range such that the durability is not impaired. Examples of the way in which such chemical bonds are introduced include the method whereby, at the time of the polymerization of the polycarbonate diol, there is included a compound having ether or ester bonds, so that copolymerization is effected, and the method in which the polycarbonate diol and a polymer diol other than this polycarbonate diol are separately polymerized, and then mixed together and the mixture used in the polyurethane polymerization.

Using some other polymer diol mixed with the polycarbonate diol, or with the copolycarbonate diol, is also preferred for raising the durability, flexibility and product quality. Where the introduced polymer diol contains from 5–70 wt % of at least one type of polymer diol selected from the group comprising polytetramethylene glycol, poly(neopentylene adipate)glycol and poly(2,5-diethylpentamethylene)adipate diol, there is a good balance between handle and durability, so this is preferred.

The molecular weight of these polymer diols is not particularly restricted and can be suitably selected taking into account the properties of the target leather-like sheet. However, if the molecular weight is less than 500, while the polymer physical properties may be enhanced the handle becomes harsh, whereas if the molecular weight exceeds 3000 then while the handle is soft there is a tendency for the physical properties to be reduced. Hence, the molecular weight is preferably 500–3000, with 800–2500 being particularly preferred.

With regard to the mixing proportions of said polymer diol, if there is less than 5 wt % there is little softness-improving effect, whereas with more than 70 wt % there is the problem that the durability is markedly lowered. From 5 to 70 wt % is preferred.

In the present invention, there are no particular restrictions on the method of producing the polyurethane and, in the usual way, there can be used the method in which the polymer diol and diisocyanate are reacted to form a prepolymer, after which this is reacted with a chain extender, or there can be employed the 'one-shot' method in which all the starting materials are mixed together and reacted. Furthermore, where required, it is also possible to copolymerize stabilizer such as ultraviolet absorbers or antioxidants.

The proportions of the polymer diol and diisocyanate in such circumstances are not particularly restricted. However, where the aim is softness/flexibility, the polymer diol may be increased and where the aim is durability the diisocyanate may be increased, but preferably the reaction conditions are adjusted such that the molar ratio of the two is from 1:1.5 to 1:5. In the case where a plurality of polymer diols and/or diisocyanates is used, these may be separately reacted to produce a number of prepolymers, after which these are mixed and reacted with a chain extender to produce a structure close to that of a block copolymer, or the prepolymer may be prepared in a mixed state and then reaction carried out with the chain extender to produce a structure close to that of a random copolymer. Furthermore, it is possible to add, for example, an organo-tin compound, an organo-titanium compound or a tertiary amine as a reaction catalyst.

There are no particular restrictions of the diisocyanate which is combined with the polymer diol and, for example, in the case where the aim is heat resistance, there can be used an aromatic diisocyanate such as 4,4'-diphenylmethanediisocyanate, while in the case where it is desired to suppress yellowing due to $NO_x$ or light then it is possible to use an alicyclic diisocyanate or an aliphatic diisocyanate such as isophorone diisocyanate, 4,4'-dicyclohexylmethane diisocyanate or 1,6-hexamethylene diisocyanate. Furthermore, depending on the objectives, there can be used a plurality of such diisocyanates in combination.

The chain extender which is reacted with the aforesaid polymer diol and diisocyanate is not particularly restricted and there can be used low molecular weight compounds having two or more active hydrogens. For example, there can be used ethylene glycol, propylene glycol, 1,6-hexanediol or other such aliphatic diol, diethylene glycol, dipropylene glycol or other such polyalkylene glycol, ethylene diamine, isophorone diamine or other such aliphatic diamine or alicyclic diamine, or methylene bis-aniline or other such aromatic diamine, with these being employed on their own or in the form of mixtures.

In particular, in the case where 4,4'-diphenylmethane diisocyanate is used as the diisocyanate, and a $C_2$–$C_8$ aliphatic diol, in particular ethylene glycol, is used as the chain extender, there can be obtained a polyurethane which is particularly outstanding in its durability and softness, so this is preferred.

The polyurethane is applied such that the polyurethane content in the sheet is from 20 to 60 wt %. While the aforesaid polycarbonate-based polyurethane has excellent durability, when it is used over a prolonged period degradation does occur. Thus, if the polyurethane content is less than 20 wt %, then even if the initial properties are good there is a deterioration in the product quality and physical properties with prolonged use, which is undesirable. Consequently, where the aim is to obtain higher durability, the polyurethane content is preferably from 25 to 60 wt %, and more preferably 30 to 60 wt %. On the other hand, when the polyurethane content exceeds 60%, not only does the handle become harsh and it feels stiff but also the polyurethane becomes visible from the surface and the product quality is markedly lowered, so it is not possible to obtain the leather-like sheet of the present invention.

As the method for applying the polyurethane, there is preferably employed the wet coagulation method in which the sheet is impregnated with a polyurethane solution, and then immersed in water or in an aqueous organic solvent solution and coagulation of the polyurethane brought about. There are no particular restrictions on the wet coagulation conditions, and there can be employed the methods normally used in the production of synthetic leather. For example, the sheet comprising ultrafine fibre can be impregnated using a solution having a polyurethane concentration of 5 to 30%, and then immersed into an aqueous solution substantially of DMF/water mixing ratio 60/40 to 0/100, at a temperature of 20–70° C., so that coagulation is effected. Again, the coagulation of the polyurethane can be carried out by immersion in turn in two or more aqueous solutions which differ in their DMF/water mixing ratio and temperature.

With regard to the solvent employed in the polyurethane solution, N,N'-dimethylformamide, dimethylsulphoxide or the like can be favourably employed. Again, adding other solvent or water within a range such that the solubility of the polyurethane is not impaired is a preferred means in terms of nap formation. Furthermore, it is also possible to add a coagulation regulator such as a higher alcohol or a surfactant with the objective of adjusting the coagulated structure of the polyurethane. Moreover, where required, there can be added pigments, ultraviolet absorbers or antioxidants.

In particular, by adding a cationic surfactant to the polyurethane solution, it is possible to considerably improve the durability of the suede-like sheet obtained. Known cationic surfactants can be used, examples of which are dodecylamine, didodecyldimethylammonium, dodecyltrimethylammonium and tetradecylpyridinium chlorides or bromides, etc. The amount of said cationic surfactant added needs to be suitably selected in accordance with the processing conditions, such as the type of impregnated substrate and the polyurethane concentration. However, generally speaking, 0.5 to 5 g/L is preferred.

The sheet material obtained in this way is subjected to a nap-forming treatment. There are no particular restrictions on this nap-forming treatment, providing the desired leather-like appearance is obtained, and known nap-raising treatments or buffing treatments can be used. In particular, by using a buffing treatment, polyurethane is eliminated from the sheet surface while adjusting the nap length, and an excellent product quality is readily obtained, so this is preferred. In this buffing treatment, by pressing the fibre sheet containing the polyurethane against a rotating polishing material having abrasive particles at the surface, as well as eliminating the polyurethane from the fibre sheet surface the fibres are suitably cut and a nap formed. As the polishing material there can be used sandpaper or rollers having abrasive particles at the surface. This buffing treatment can be repeated several times where required.

Finally, by subjecting the sheet thus obtained to dyeing and finishing treatments, the leather-like sheet is obtained. The dyeing and finishing treatment methods are not particularly restricted and known methods can be employed.

The equipment used for the dyeing treatment is not particularly restricted and, providing it is equipment which can be employed for normal polyester dyeing, it can be used without particular problems, but in order to facilitate the obtaining of a soft handle and open nap, it is preferred that there be used a jet dyeing machine. Again, for the purposes of enhancing the dyeing uniformity and the reproducibility, it is preferred that there be added a dyeing assistant. The present invention is characterized by the fact that in the case of the leather-like sheet obtained in this way the percentage retention of the local failure resistance before and after accelerated aging is at least 50%.

The accelerated aging treatment in the present invention refers to leaving the leather-like sheet for 5 weeks in a constant-temperature constant-humidity, chamber regulated to a temperature of 70° C. and a relative humidity of 95%.

Furthermore, the local failure resistance in the present invention is measured in the following manner.

Figure 3:
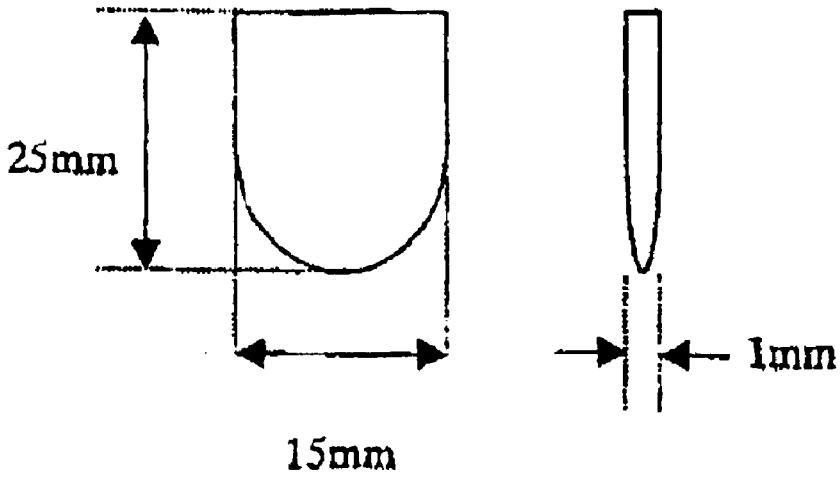
FIG. 3 is an outline diagram showing the form of the fingernail-shaped portion in the present invention.

First of all, for the measurement there is used equipment as shown in FIG. 1. (1) is a sheet clamp. (2) is a rotating roller, and in the state shown in FIG. 1 this is rotated electrically in the counter-clockwise direction as viewed from this side. The diameter is 30 mm. (3) is a fingernail-shaped part, and has the form shown in FIG. 3. The thickness of this fingernail-shape portion is 1 mm and the radius of curvature of the tip is 7.5 mm. The material used is SUS304. (4) is a guide roller and it is a free roller which rotates practically without resistance.

Figure 2:
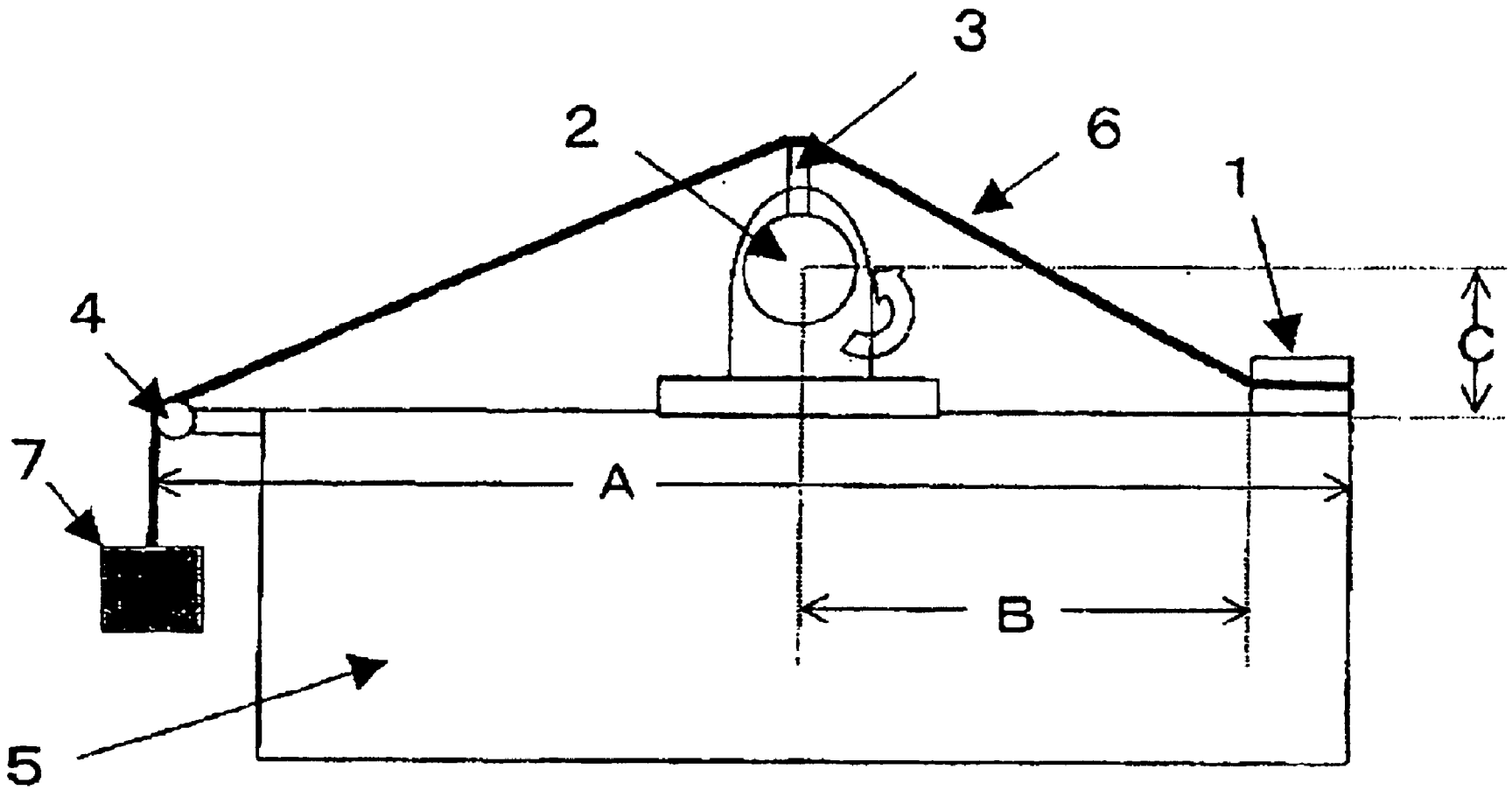
FIG. 2 is an outline diagram showing schematically the local failure resistance test in the present invention.

Using this equipment, the local failure resistance is measured by the following procedure. Explaining with reference to FIG. 2, the sample to be evaluated is cut to a width of 10 cm and length 50 cm, and the lengthwise direction end is fixed by the sheet clamp ((1) in FIG. 2). Next, a load (represented by (7) in FIG. 2) is secured to the unfixed end of the sample to be evaluated, and hung down with the sample passing over the guide roller ((4) in FIG. 2).

The relative positional relationship of the various components is as follows. The distance between the guide roller and the sheet clamp (indicated by A in FIG. 2) is 290 mm, the horizontal distance between the sheet clamp and the central axis of the rotating roller (indicated by B in FIG. 2) is 140 mm, and the distance in the height direction (indicated by C in FIG. 2) is 35 mm.

Thus, the rotating roller is made to rotate in a state with a fixed tension applied to the synthetic leather and then, with the tip region of the fingernail portion rubbing against the surface of the leather-like sheet, the number of rotations is measured up to failure of the synthetic leather. The rate of rotation of the electrically-driven roller is made 1 rev per second. In the case where the leather-like sheet has a structure in which a woven/knitted material and a nonwoven material have been entangled together and/or in the case of a structure where there is a surface woven/knitted material clad to at least one side, failure is judged to be the point where said woven/knitted material is exposed by the shaving away of the surface.

Hitherto, as methods for evaluating the durability of a leather-like sheet comprising fibre and polyurethane, there have generally been employed the breaking strength, the surface wear resistance and measurement of the polyurethane molecular weight, etc. However, in actual use, there is a complex relation with for example changes in the entangled state of the fibre and degradation of the polyurethane, and while a value may be excellent by such evaluation methods, when the sheet is used in practice surface pilling occurs, the nap becomes extremely long or, in severe cases, failure occurs, in a shorter time than predicted. The present inventors have taken into account the degradative factors during actual use, and have employed a combination of the resistance to local failure, as specified in the present invention, and an accelerated aging treatment. They have confirmed that, where these characteristics are satisfied, there is obtained a suede-like sheet which does not exhibit pilling or failure when used over a prolonged period.

Moreover, in the case of the aforesaid suede-like sheet, still higher durability can be realized if the local failure resistance is at least a value of 70 after carrying out the accelerated ageing treatment stipulated in this Specification, so this is preferred.

Furthermore, it is preferred in the present invention that the ultrafine fibre comprises polyester, that there be used a polyurethane such that, when the amount of dyestuff contained in the polyurethane following the dyeing of the suede-like sheet with a disperse dyestuff is taken as A and the amount of dyestuff contained in the polyurethane following a subsequent reducing wash is taken as B, the dyeability index B/A is at least 0.3 and, furthermore, that the wet rubbing fastness as measured in accordance with JIS L0849 is at least grade 3.

The methods of measuring said values A and B are as follows. First of all, a 25% dimethylformamide solution (hereinafter referred to as the DMF solution) of the polyurethane is prepared. Now, in case where the dyeability index is measured after extraction of polyurethane from the leather-like sheet following dyeing, it is necessary to substantially totally eliminate the dyestuff from the polyurethane. As a method for eliminating the dyestuff, there can be employed a repeated purification treatment method comprising mixing the solution with a solvent which will dissolve the dyestuff present in the DMF solution of the polyurethane but in which the polyurethane is not itself soluble, so that the polyurethane is precipitated out.

After casting the aforesaid DMF solution of the polyurethane onto a glass plate to a thickness of 1 mm, the glass plate is immersed in water to prepare a wet-cast film. Next, this wet-cast film is thoroughly washed and dried, after which dyeing is carried out for 45 minutes at 120° C. using "Sumikaron Brilliant Red SE2BF" (produced by the Sumitomo Chemical Co.) At a bath ratio 1:30 based on the addition of 10% of the dyestuff in terms of the weight of wet-cast film. Thereafter, the polyurethane film is removed and thoroughly washed with water, after which 20 mg of the polyurethane film is taken and dissolved in 200 mL of DMF. Next, the absorbance of this polyurethane DMF solution is measured and the dyestuff content A of the polyurethane after dyeing is determined from a previously-constructed calibration curve. Furthermore, the aforesaid remaining polyurethane film which has been dyed and washed is then subjected to a 20 minute reduction wash at 80° C. using water containing 2 g/L of sodium hydroxide, 8 g/L of hydrosuiphite and 1 g/L of Gran-Up US20 (produced by Sanyo Chemical Industries), at a bath ratio of 1/20, after which the polyurethane film is removed, thoroughly washed with water and then the dyestuff content B of the polyurethane after the reduction wash determined by the same procedure as above.

Where the value of the dyeability index B/A determined in this way is less than 0.3, the polyurethane is substantially undyed, so it is not possible to achieve adequate coloration which is an objective of the present invention. Consequently, it is necessary for the value of B/A to be at least 0.3, and preferably it is at least 0.5.

Again, it is necessary that the wet rubbing fastness measured by JIS L0849 be at least grade 3. The leather-like sheet is obtained by raising the crystallinity of the polyurethane from which the leather-like sheet is composed. However, even when using a polyurethane which can exhaust the dyestuff, if the wet rubbing fastness is inadequate then, during use, there will be considerable dye transfer to other fibre materials, so it becomes essentially impossible to use in practice. There are no particular restrictions on the means used for achieving good wet rubbing fastness, providing the objectives of the invention are satisfied, but increasing the cohesive force of the polyurethane molecules is an effective method. As an example of this method, there is the method of raising the ratio of polymer diol to diisocyanate at the time of the polyurethane polymerization. The ratio of polymer diol to diisocyanate is preferably at least 2.5, more preferably at least 3.0 and still more preferably at least 3.5.

Furthermore, in the dyeing of the suede-like sheet, it is preferred that the dyeing be carried out under conditions comprising a maximum temperature of 110–130° C., and preferably 115–125° C. If the maximum temperature is less than 105° C., or if it exceeds 130° C., it is difficult to achieve exhaustion of the dyestuff by the fibre and the colouring properties are lowered. Furthermore, having attained this maximum temperature during the dyeing treatment, the dyeing is then carried out while maintaining the temperature such that there is uniform thorough exhaustion of the dyestuff by the sheet, but the time period thereof is preferably suitably set according to the type of dyestuff. That is to say, normally a time in the range from about 30 to 90 minutes is preferred but, for example, it is generally difficult to achieve exhaustion with dyestuffs of good fastness, so it may be appropriate to carry out a longer treatment at the maximum temperature. However, even in such circumstances, the time needs to be set taking into account degradation of the polyurethane, etc. Furthermore, it is also possible to promote exhaustion of the dyestuff by the fibre by adding a carrier to the dyebath within a range such that the dye fastness is not reduced.

In the aforesaid suede-like sheet, the average nap length is 300–2000 μm, preferably 500–1500 μm, and it is preferred that the weight loss by rubbing in the brush rubbing test be no more than 25 mg. If the average nap length is less than 300 μm, then there will be considerable polyurethane exposure at the surface, so that the appearance is poor, which is undesirable. Again, if the average nap length is greater than 2000 μm, then fibres severed during wear will tend to produce pilling, so there is the problem of lowered rubbing resistance, which is undesirable. Moreover, if the weight loss by rubbing exceeds 25 mg, there will be marked shedding of the nap so, while pilling will not readily occur, there will be a marked change in appearance and, in an extreme case, the sheet will have a 'worn-out' appearance. Thus, it is not possible to achieve the high durability which is an objective of the present invention.

The average nap length referred to here is determined by taking a photograph at a magnification of 100× using an optical microscope, and then determining the average length of 50 randomly selected nap fibres.

Furthermore, the weight loss by rubbing in the brush rubbing test referred to here is determined by rubbing the surface of a circular sample of diameter 4.5 cm which has undergone the aforesaid accelerated aging treatment, by rotation of a specified brush under a fixed load, as specified below, and measuring the change in the weight before and after rubbing.

(a) brush: circular brush with 9700 projecting bristles, comprising bunches of 100 nylon bristles of length 1.1 mm and diameter 0.4 mm, with 97 said bunches arranged in the form of six concentric circles within a circle of diameter 110 mm (b) load: 3600 g (c) rotations: 45 (at a rotation rate of 65 rpm)

The present invention is also characterized in that, preferably, after the application of an antistatic agent, a buffing treatment is carried out. Antistatic agents can broadly be classified into low molecular weight and high molecular weight types, and there are no particular restrictions thereon providing the objectives of the present invention are satisfied. For example, as low molecular weight antistatic agents there can be used nonionic antistatic agents such as glycerol fatty acid esters, higher alcohol EO adducts, polyethylene glycol fatty acid esters or the like, anionic antistatic agents such as alkylsulphonates, higher alcohol sulphate ester salts, higher alcohol EO adduct sulphate ester salts, higher alcohol phosphate ester salts or higher alcohol EO adduct phosphate ester salts, cationic antistatic agents such as tetraalkylammonium salts or the like, and amphoteric antistatic agents such as those of the alkylbetaine type. Furthermore, as high molecular weight antistatic agents there can be used nonionic antistatic agents such polyethers, polyetherpolyesteramides, polyetheramideimides, methoxypolyethyleneglycol (meth)acrylate copolymers and the like, anionic antistatic agents such as polystyrene sulphonates, and cationic antistatic agents such as quaternary ammonium salt group-containing (meth)acrylate copolymers, quaternary ammonium salt group-containing maleimide copolymers or the like.

The amount of antistatic agent applied will depend on the type of antistatic agent but, in terms of the sheet weight prior to buffing, it is preferably from 0.03 to 3% and more preferably from 0.05 to 1%. If the amount applied is less than 0.03%, then there is not fully obtained the effect which is the objective of the invention, while once the amount applied exceeds 3% there is practically no further change in effect and the cost is merely raised, which is undesirable.

Furthermore, these antistatic agents may be used on their own, or two or more antistatic agents may be employed in combination. With regard to the method of applying two or more antistatic agents in combination, after applying one antistatic agent the other(s) may then be applied, or a plurality of antistatic agents may be mixed together within a range such that they do not aggregate or precipitate, and then applied.

There are no particular restrictions on the method for applying the antistatic agent, and there may be used, for example, a spray method, a method of application using a coater or the method of impregnating with a solution containing the antistatic agent, followed by squeezing by the nip between rollers.

In terms of the physical properties of the sheet following the application of the antistatic agent, it is preferred that the frictional electricity measured by the method described in JIS L1094 B lies in the range from −500 to +5,000 V, and more preferably in the range from −100 to 3,000 V. If the frictional electricity lies outside the range −500 to +5000 V, the buffing debris will tend to adhere to the sheet surface, sandpaper and air nozzle, etc, so that the beneficial effects of the invention are not fully realized. Hence, this is undesirable.

Again, preferably, in the present invention the buffing treatment is conducted after application of a silicone lubricant along with the antistatic agent. By the combination of such silicone lubricant and antistatic agent, it is possible to obtain a leather-like sheet of elegant appearance, having a long surface nap, a suitable degree of lustre and little dyeing unevenness at the time of dyeing. As the silicone lubricant, there can be used, for example, dimethyl polysiloxane, methyl hydrogen polysiloxane, amino-modified silicone or carboxy-modified silicone. There are no particular restrictions on the method for applying the silicone lubricant, and there may be used for example a spray method, a method of application using a coater or the method of impregnating with a solution containing the antistatic agent, followed by squeezing by the nip between rollers. Again, either the antistatic agent or silicone lubricant may be applied first and the other subsequently applied, or they may be mixed and applied together. Furthermore, there may also be applied other chemicals such as coagulation preventives, within a range such that the effects of the present invention are not impaired.

The amount of silicone lubricant applied is preferably 0.03 to 1 wt %, and more preferably 0.05 to 0.3 wt %, in terms of the sheet weight before the buffing treatment. If the applied amount of silicone lubricant is less than 0.03 wt %, there is formed a material of short nap and inferior surface quality, so this is undesirable. Furthermore, if the amount applied is over 1 wt % then, since the coefficient of friction of the sheet surface becomes too low, the processability is adversely affected in that, for example, at the time of buffing the sheet readily tends to meander and silicone lubricant is transferred to the buffing machine.

Elaborating further, the coefficient of friction between the sheet and sandpaper at the time of the buffing treatment is an important factor which influences the surface quality of the leather-like sheet. By lowering the coefficient of friction between the sheet and sandpaper, the polyurethane tends to be preferentially buffed rather than the ultrafine fibre, with the result that there is obtained a leather-like sheet of long nap and having a suitable degree of lustre. However, it is not just the silicone lubricant alone but also the antistatic agent which has the function of reducing the coefficient of friction between the sheet and sandpaper, and thus it is thought that by applying antistatic agent a leather-like sheet of more outstanding surface quality is obtained.

Industrial Application Potential

The present invention relates to a suede-like sheet which is used in clothing applications and in materials applications. In particular, it is effective for obtaining a suede-like sheet which is outstanding in its flexibility, durability and quality.

EXAMPLES

Below, the present invention is explained in more specific terms by means of practical examples.

The mixing proportions in the examples are weight ratios unless otherwise state.

The meanings of the codes employed in the examples are as follows.

| | |
|---|---|
| EG: | ethylene glycol |
| DMF: | N,N'-dimethylformamide |
| MBA: | methylene bis-aniline |
| MDI: | 4,4'-diphenylmethane diisocyanate |
| PCL: | polycaprolactone diol |
| PHC: | poly(hexamethylene carbonate)diol |
| PTMG: | polytetramethylene glycol |

Furthermore, the evaluation methods used in the examples were as follows.

(1) Frictional Electricity

This was measured based on JIS L1094 B, at room temperature (20° C.) and 40% humidity.

(2) Average Nap Length

Using an optical microscope, a photograph was taken at a magnification of 100 and then the average length of 50 randomly selected nap fibres was determined.

(3) Local Failure Resistance Retention and the Failure Resistance after an Accelerated Aging Treatment The local failure resistance was evaluated by the following method before and after an accelerated aging treatment, and then the local failure resistance retention and the value of the failure resistance after the accelerated aging were determined.

A. Local Failure Resistance

Measurement was carried out by the method described elsewhere in the Specification.

B. Accelerated Ageing Treatment

The suede-like sheet was left for 5 weeks in a constant-temperature constant-humidity chamber (EY-101, produced by the Tobai ESPEC Co.) adjusted to a temperature of 70° C. and a relative humidity of 95%.

(4) Dyeability Index

This was measured by the method described elsewhere in the Specification.

(5) Wet Rubbing Fastness

This was measured based on JIS L0849.

(6) Weight Loss by Rubbing in the Brush-Rubbing Test

This was measured by the method described elsewhere in the Specification.

Example 1

A polyurethane was obtained in the usual way, employing a 50:50 mixture of PHC of molecular weight 2000 and PNA of molecular weight 2000 as the polymer diol, MDI as the diisocyanate and EG as the chain extender. This was diluted with DMF to a solids content of 12 wt % and 1.5 wt % of a benzophenone type ultraviolet absorber added as an additive, to prepare the polyurethane impregnation liquid.

Separately, using a spinneret for producing islands-in-a-sea type conjugate fibre, there was prepared islands-in-a-sea type conjugate fibre under the following conditions.

| | |
|---|---|
| sea component: | polystyrene |
| islands component | polyethylene terephthalate |
| proportions: | 30% sea, 70% islands |

This islands-in-a-sea type conjugate fibre was drawn by a factor of 3.1 and given a crimp, after which it was cut and the raw stock obtained. This raw stock was formed into a web using a cross lapper, then needle punching carried out and a nonwoven material of weight per unit area 500 g/m$^2$ and punch density 2300 per cm$^2$ obtained. After impregnating this nonwoven material with 10% polyvinyl alcohol aqueous solution, it was mangled and dried. Subsequently, the sea component was extracted with trichloroethylene and there was obtained a fibre sheet comprising 0.2 dtex ultrafine fibre.

This fibre sheet was immersed in the aforesaid polyurethane impregnation liquid and after adjusting the take-up of the polyurethane impregnation liquid by means of squeezing rollers, the polyurethane was coagulated in aqueous DMF solution. Thereafter, the DMF and polyvinyl alcohol were removed with hot water and, following drying, impregnation was carried out with an aqueous solution of nonionic antistatic agent (Elenite 139, produced by Takamatsu Yushi K.K.). After squeezing-out with nip rollers, drying was performed. The sheet was then subjected to buffing and dyed with disperse dye, and in this way the suede-like sheet was obtained. The features of the production method in this example and the properties of the suede-like sheet obtained are shown in Table 1.

Example 2

A suede-like sheet was obtained in the same way as in Example 1 except that, instead of applying a nonionic antistatic agent by itself, application was performed by impregnation with a mixed aqueous dispersion of nonionic antistatic agent (Elenite 139; produced by Takamatsu Yushi K.K.) and silicone lubricant (SH7036; produced by the Toray Dow Corning Silicone Co.), followed by squeezing with nip rollers and drying. The features of the production method in this example and the characteristics of the suede-like sheet obtained are shown in Table 1.

Comparative Example 1

Polyurethane was obtained in the usual way employing a 20:80 mixture of PHC of molecular weight 2000 and PNA of molecular weight 2000 as the polymer diol, MDI as the diisocyanate and EG as a chain extender. Then, a suede-like sheet was obtained under the same conditions as in Example 4 except that there was used this polyurethane as the polyurethane employed. The features of the production method in this comparative example and the characteristics of the suede-like sheet obtained are shown in Table 1.

Example 3

A suede-like sheet was obtained under the same conditions as in Example 2 except that, instead of a nonwoven material obtained by producing a web from the islands-in-a-sea type conjugate fibre raw stock using a cross lapper and then needle punching at a punch density of 2,300 per cm$^2$, there was used a nonwoven material prepared by first obtaining a staple nonwoven material of weight per unit area 250 g/m$^2$ by producing a web of the raw stock using a cross lapper and carrying out needle punching at a punch density of 2000 per cm$^2$, then superimposing two layers of this staple nonwoven material and, in this state, bonding together at a punch density of 300 per cm$^2$. The features of the production method in this example and the characteristics of the suede-like sheet obtained are shown in Table 1.

Example 4

A polyurethane was obtained in the usual way, employing a 70:30 mixture of PHC of molecular weight 2000 and PTMG of molecular weight 2000 as the polymer diol, MDI as the diisocyanate and EG as a chain extender. This was diluted with DMF to give a solids content of 11 wt % and 1.0 wt % of a benzophenone type ultraviolet absorber added as an additive, to prepare the polyurethane impregnation liquid.

Separately, using a spinneret for producing islands-in-a-sea type conjugate fibre, there was prepared islands-in-a-sea type conjugate fibre under the following conditions.

| | |
|---|---|
| sea component: | polystyrene |
| islands component | polyethylene terephthalate |
| proportions: | 50% sea, 50% islands |

This islands-in-a-sea type conjugate fibre was drawn by a factor of 3.2 and given a crimp, after which it was cut and the raw stock obtained. This raw stock was formed into a web using a cross lapper, then needle punching carried out at a punch density of 2000 per cm$^2$ and a staple nonwoven material of weight per unit area 250 g/m$^2$ and obtained. Then, two layers of this staple nonwoven material were superimposed and, in this state, bonded together at a punch density of 300 per cm$^2$, to produce the nonwoven material. After immersing this nonwoven material in 10% polyvinyl alcohol aqueous solution, it was mangled and dried. Subsequently, the sea component was extracted with trichloroethylene and there was obtained fibre sheet comprising 0.1 dtex ultrafine fibre.

This fibre sheet was immersed in the aforesaid polyurethane impregnation liquid and after adjusting the applied amount of polyurethane impregnation liquid by means of squeezing rollers, the polyurethane was coagulated in aqueous DMF solution. Thereafter, the DMF and polyvinyl alcohol were removed with hot water and, following drying, immersion was carried out in a mixed aqueous dispersion of nonionic antistatic agent (Elenite 139, produced by Takamatsu Yushi K.K.) and silicone lubricant (SH7036; produced by the Toray Dow Corning Silicone Co.). After squeezing with nip rollers, drying was performed. The sheet was then subjected to buffing and dyed with disperse dye, and in this way the suede-like sheet was obtained. The features of the production method in this example and the characteristics of the suede-like sheet obtained are shown in Table 1.

Example 5

Polyurethane was obtained in the usual way, employing a 70:30 mixture of PHC of molecular weight 2000 and PCL of molecular weight 2000 as the polymer diol, MDI as the diisocyanate and MBA as a chain extender. Then a suede-like sheet was obtained under the same conditions as in Example 4 except that there was used this polyurethane as the polyurethane employed. The features of the production method in this example and the characteristics of the suede-like sheet obtained are shown in Table 1.

Example 6

Polyurethane was obtained in the usual way, employing an 85:15 mixture of PHC of molecular weight 2000 and PCL of molecular weight 2000 as the polymer diol, MDI as the diisocyanate and MBA as a chain extender. Then a suede-like sheet was obtained under the same conditions as in Example 4 except that there was used this polyurethane as the polyurethane employed. The features of the production method in this example and the characteristics of the suede-like sheet obtained are shown in Table 1.

Comparative Example 2

Polyurethane was obtained in the usual way, employing a 20:80 mixture of PHC of molecular weight 2000 and PTMG of molecular weight 2000 as the polymer diol, MDI as the diisocyanate and MBA as a chain extender. Then a suede-like sheet was obtained under the same conditions as in Example 4 except that there was used this polyurethane as the polyurethane employed. The features of the production method in this comparative example and the characteristics of the suede-like sheet obtained are shown in Table 1.

Comparative Example 3

Polyurethane was obtained in the usual way, employing PHC of molecular weight 2000 by itself as the polymer diol, MDI as the diisocyanate and MBA as a chain extender. Then a suede-like sheet was obtained under the same conditions as in Example 4 except that there was used this polyurethane as the polyurethane employed. The features of the production method in this comparative example and the characteristics of the suede-like sheet obtained are shown in Table 1.

Comparative Example 4

A suede-like sheet was obtained under the same conditions as in Example 6 except that no antistatic agent and silicone oil were applied before the buffing. The features of the production method in this comparative example and the characteristics of the suede-like sheet obtained are shown in Table 1.

| | Examples | | | | | | Comparative Examples | | | |
|---|---|---|---|---|---|---|---|---|---|---|
| | 1 | 2 | 3 | 4 | 5 | 6 | 1 | 2 | 3 | 4 |
| Fineness dtex | 0.2 | 0.2 | 0.2 | 0.1 | 0.1 | 0.1 | 0.2 | 0.1 | 0.1 | 0.1 |
| Felt production method* | 2 | 2 | 1 | 1 | 1 | 1 | 2 | 1 | 1 | 1 |
| Polycarbonate diol | | | | | | | | | | |
| type | PHC | PHC | PHC | PHC | PHC | PHC | PHC | PHC | PHC | PHC |
| % | 50 | 50 | 50 | 70 | 70 | 85 | 20 | 20 | 100 | 85 |

-continued

| | Examples | | | | | | Comparative Examples | | | |
|---|---|---|---|---|---|---|---|---|---|---|
| | 1 | 2 | 3 | 4 | 5 | 6 | 1 | 2 | 3 | 4 |
| Other polymer diol | | | | | | | | | | |
| type | PNA | PNA | PNA | PTMG | PCL | PCL | PNA | PTMG | — | PCL |
| % | 50 | 50 | 50 | 30 | 30 | 15 | 80 | 80 | — | 15 |
| Polyurethane content % | 35 | 35 | 35 | 25 | 25 | 25 | 35 | 25 | 25 | 25 |
| Antistatic agent % | 0.1 | 0.1 | 0.1 | 0.1 | 0.1 | 0.1 | 0.1 | 0.1 | 0.1 | 0 |
| Silicone lubricant % | 0 | 0.1 | 0.1 | 0.2 | 0.2 | 0.2 | 0.1 | 0.2 | 0.2 | 0 |
| Frictional electricity before buffing V | +11 | +13 | +15 | +16 | +15 | +14 | +11 | +9 | +9 | +7600 |
| Average nap length μm | 659 | 1015 | 1098 | 1205 | 1134 | 988 | 1201 | 1302 | 154 | 220 |
| Local failure resistance retention % | 60 | 78 | 82 | 87 | 91 | 88 | 33 | 40 | 93 | 93 |
| Failure resistance after accelerated ageing times | 65 | 112 | 132 | 115 | 124 | 133 | 34 | 40 | 144 | 119 |
| Dyeability index B/A | 0.59 | 0.59 | 0.59 | 0.53 | 0.62 | 0.65 | 0.45 | 0.09 | 0.56 | 0.62 |
| Wet-rubbing fastness grade | 4 | 4 | 4 | 4 | 4 | 4 | 4 | 4 | 4 | 4 |
| Weight loss on rubbing mg | 14 | 18 | 14 | 15 | 11 | 12 | 33 | 40 | 7 | 10 |

*Methods of felt production

1: Two thin layers of web were superimposed and then needle punching/polyurethane impregnation performed, after which slicing was carried out to produce two sheets of nonwoven material 2: A thick web was subjected to needle punching, then impregnated with polyurethane, to produce one sheet of nonwoven

What is claimed is:

1. A suede-like sheet comprising primarily ultrafine fibre of no more than 0.3 dtex and 20 wt % to 60 wt % polyurethane, wherein said polyurethane comprises polymer diol which contains from 50 wt % to 90 wt % polycarbonate diol, the average nap length is 300 μm to 2000 μm, and the percentage retention of local failure resistance before and after an accelerated aging treatment is at least 50%.

2. The suede-like sheet according to claim 1, wherein the local failure resistance following the accelerated aging treatment is at least 70 times.

3. The suede-like sheet according to claim 1, wherein the polycarbonate diol is poly(1,6-hexamethylene carbonate) diol.

4. The suede-like sheet according to claim 1, wherein the polymer diol contains 5 wt % to 70 wt % of at least one type of polymer diol selected from the group consisting of polytetramethylene glycol, poly(neopentylene adipate) diol, polycaprolactone diol and poly(2,5-diethylpentamethylene adipate) diol.

5. The suede-like sheet according to claim 1, wherein the polyurethane is a polyurethane comprising polymer diol containing from 50 wt % to 85 wt % polycarbonate diol.

6. The suede-like sheet according to claim 1, wherein the ultrafine fibre comprises polyester, and there is used polyurethane such that, when the amount of dyestuff contained in the polyurethane following dyeing of the suede-like sheet with a disperse dyestuff is taken as A and the amount of dyestuff contained in the polyurethane following subsequent reduction washing is taken as B, the dyeability index B/A is at least 0.3 and the wet rubbing fastness as measured in accordance with JIS L0849 is at least grade 3.

7. The suede-like sheet according to claim 1, wherein the average nap is from 500 μm to 1500 μm.

8. The suede-like sheet according to claim 1, wherein rubbing weight loss based on a brush rubbing test of the suede-like sheet is no more than 25 mg.

9. A method for the production of a suede-like sheet wherein, in the preparation of a suede-like sheet comprising a nonwoven fabric of ultrafine fibre of no more than 013 dtex and a polyurethane which employs polymer diol containing 50 wt % to 90 wt % of polycarbonate diol, a buffing treatment is carried out after applying an antistatic agent to the sheet.

10. The method for the production of a suede-like sheet according to claim 9 wherein the buffing treatment is carried out after applying an antistatic agent and a silicone lubricant to the sheet.

11. The method for the production of a suede-like sheet according to claim 9 wherein the buffing treatment is carried out after applying antistatic agent to the sheet such that the frictional electricity measured by the method described in JIS L1094 B is from −500 to +5000 V.

12. The method for the production of a suede-like sheet according to claim 9 wherein bonding is carried out in a state with two layers of ultrafine fibre nonwoven material or ultrafine fibre-generating fibre nonwoven material superimposed, and the nonwoven material is subsequently sliced into two in the thickness direction.

* * * * *

UNITED STATES PATENT AND TRADEMARK OFFICE

CERTIFICATE OF CORRECTION

PATENT NO. : 6,811,572 B2
DATED : November 2, 2004
INVENTOR(S) : Hashimoto et al.

It is certified that error appears in the above-identified patent and that said Letters Patent is hereby corrected as shown below:

Columns 15 and 17,
Please replace "Table 1" with the following on the attached page:

Signed and Sealed this

Nineteenth Day of April, 2005

JON W. DUDAS
*Director of the United States Patent and Trademark Office*

Table 1

| | | Examples | | | | | | Comparative Examples | | | |
|---|---|---|---|---|---|---|---|---|---|---|---|
| | | 1 | 2 | 3 | 4 | 5 | 6 | 1 | 2 | 3 | 4 |
| Fineness | dtex | 0.2 | 0.2 | 0.2 | 0.1 | 0.1 | 0.1 | 0.2 | 0.1 | 0.1 | 0.1 |
| Felt production method* | | 2 | 2 | 1 | 1 | 1 | 1 | 2 | 1 | 1 | 1 |
| Polycarbonate diol | type | PHC | PHC | PHC | PHC | PHC | PHC | PHC | PHC | PHC | PHC |
| | % | 50 | 50 | 50 | 70 | 70 | 85 | 20 | 20 | 100 | 85 |
| Other polymer diol | type | PNA | PNA | PNA | PTMG | PCL | PCL | PNA | PTMG | - | PCL |
| | % | 50 | 50 | 50 | 30 | 30 | 15 | 80 | 80 | - | 15 |
| Polyurethane content | % | 35 | 35 | 35 | 25 | 25 | 25 | 35 | 25 | 25 | 25 |
| Antistatic agent | % | 0.1 | 0.1 | 0.1 | 0.1 | 0.1 | 0.1 | 0.1 | 0.1 | 0.1 | 0 |
| Silicone lubricant | % | 0 | 0.1 | 0.1 | 0.2 | 0.2 | 0.2 | 0.1 | 0.2 | 0.2 | 0 |
| Frictional electricity before buffing | V | +11 | +13 | +15 | +16 | +15 | +14 | +11 | +9 | +9 | +7600 |
| Average nap length | μm | 659 | 1015 | 1098 | 1205 | 1134 | 988 | 1201 | 1302 | 154 | 220 |
| Local failure resistance retention | % | 60 | 78 | 82 | 87 | 91 | 88 | 33 | 40 | 93 | 93 |
| Failure resistance after accelerated ageing | times | 65 | 112 | 132 | 115 | 124 | 133 | 34 | 40 | 144 | 119 |
| Durability index B/A | | 0.59 | 0.59 | 0.59 | 0.53 | 0.62 | 0.65 | 0.45 | 0.09 | 0.56 | 0.62 |
| Wet-rubbing fastness | grade | 4 | 4 | 4 | 4 | 4 | 4 | 4 | 4 | 4 | 4 |
| Weight loss on rubbing | mg | 14 | 18 | 14 | 15 | 11 | 12 | 33 | 40 | 7 | 10 |

* Methods of felt production

1: Two thin layers of web were superimposed and then needle punching/polyurethane impregnation performed, after which slicing was carried out to produce two sheets of nonwoven material.

2: A thick web was subjected to needle punching, then impregnated with polyurethane, to produce one sheet of nonwoven